US010786839B2

(12) United States Patent
Dimitroff

(10) Patent No.: US 10,786,839 B2
(45) Date of Patent: Sep. 29, 2020

(54) INTERNAL PIPE CLEANING TOOL AND METHOD

(71) Applicant: Ted R. Dimitroff, Columbia, MO (US)

(72) Inventor: Ted R. Dimitroff, Columbia, MO (US)

( * ) Notice: Subject to any disclaimer, the term of this patent is extended or adjusted under 35 U.S.C. 154(b) by 0 days.

(21) Appl. No.: 16/239,104

(22) Filed: Jan. 3, 2019

(65) Prior Publication Data

US 2019/0201946 A1 Jul. 4, 2019

Related U.S. Application Data

(60) Provisional application No. 62/613,320, filed on Jan. 3, 2018.

(51) Int. Cl.
*B08B 9/043* (2006.01)
*B08B 9/045* (2006.01)
*B08B 9/047* (2006.01)

(52) U.S. Cl.
CPC ..... *B08B 9/0436* (2013.01); *B08B 9/045* (2013.01); *B08B 9/047* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,706,748 | A * | 11/1987 | Harris | E21B 37/02 166/173 |
| 7,581,600 | B1 | 9/2009 | Dimitroff | |
| 7,674,072 | B2 | 3/2010 | Shook et al. | |
| 8,365,841 | B2 | 2/2013 | Dimitroff | |
| 8,641,326 | B2 | 2/2014 | Dimitroff | |
| 2004/0129498 | A1* | 7/2004 | Pujol | B08B 9/00 184/6.14 |
| 2011/0299941 | A1 | 12/2011 | Dimitroff | |

* cited by examiner

*Primary Examiner* — Erin F Bergner
(74) *Attorney, Agent, or Firm* — McKee, Voorhees & Sease, PLC

(57) ABSTRACT

A pipe cleaning tool has a longitudinally extending hollow shaft with a honer head on the forward end and stabilizing legs behind the honer head. The shaft is adapted to be connected to a machine for pulling the tool through the pipe while rotating the tool such that the cutting elements on the reamer head remove debris from the inside wall of the pipe. The legs center and stabilize the reamer head to prevent contact with the internal pipe wall during the cleaning operation. Water or other lubricating fluid is ejected from the shaft during use of the tool to lubricate the tool in the pipe, and to flush loose debris out of the path of the tool.

9 Claims, 3 Drawing Sheets

INTERNAL PIPE CLEANING TOOL AND METHOD

CROSS-REFERENCE TO RELATED APPLICATIONS

This application claims priority to Provisional Application U.S. Ser. No. 62/613,320, filed on Jan. 3, 2018, which is herein incorporated by reference in its entirety.

BACKGROUND OF THE INVENTION

New water and sewer pipes have a smooth interior surface or wall, which is ideal for fluid flow through the pipes. Over time, material and debris can build up on the interior pipe wall, thereby minimizing laminate fluid flow and increasing turbulent fluid flow. Therefore, it is necessary to periodically clean the interior pipe walls in order to maintain full fluid flow through the pipes. Cleaning of the inside wall of these pipes is also required before installing a liner sleeve. Prior art cleaning methods utilize high pressure water from rotating tools inserted into the pipe to clean the internal pipe wall. However, such high-pressure cleaning leaves the inside of the pipe rough, which is detrimental to optimum fluid flow and to relining. High pressure water tools also do not have the power of mechanical cleaning by a machine, and can damage the inside wall of the pipe or burst the pipe wall.

Therefore, a primary objective of the present invention is the provision of a tool and method for honing the inside of an existing pipe, without damaging the pipe.

Another objective of the present invention is the provision of a tool and method for mechanically cleaning the inside wall of water and sewer pipes.

A further objective of the present invention is a provision of a tool and method for cleaning the inside wall of water and sewer pipes using a cleaning head which does not touch the inside wall of the pipes.

Yet another objective of the present invention is the provision of a tool and method for honing the inside surface of pipes by stabilizing a honer head into close proximity with the interior pipe wall, without touching the head to the wall.

Still another objective of the present invention is a provision of a pipe cleaning tool to improve fluid flow through the pipe.

Another objective of the present invention is the provision of a pipe cleaning tool which is rotated while pulled through the pipe to remove debris from the inside wall of the pipe.

Still another objective of the present invention is the provision of a method of cleaning the inside wall of a pipe using a rotating reaming head pulled through the pipe.

Another objective of the present invention is the provision of a pipe cleaning tool having interchangeable honer heads.

Another objective of the present invention is the provision of a pipe cleaning tool which is economical to manufacture, and durable and safe in use.

These and other objectives have become apparent from the following description of the invention.

SUMMARY OF THE INVENTION

The pipe cleaning tool of the present invention includes a honing or reaming head mounted on a hollow shaft which is pulled through a pipe while rotating so that the head removes debris from the inside wall of the pipe. The diameter of the head is in close proximity to the internal pipe wall. The head is stabilized by a plurality of legs attached to the shaft behind the honer head and extending longitudinally. The legs defined a perimeter slightly larger than the diameter of the honer head and slightly smaller than the inside diameter of the pipe.

In use, the forward end of the shaft is coupled to a machine for pulling and rotating the tool within the pipe, so that the cutting elements of the honer head remove debris from the inside wall of the pipe. The legs stabilize the head to prevent direct contact of the cutting elements with the pipe wall. A lubricant, such as water, flows through the hollow shaft and is ejected through ports adjacent to the reamer head as a tool rotates, so as to provide lubrication during the cleaning operation.

BRIEF DESCRIPTION OF THE DRAWINGS AND PHOTOGRAPHS

DESCRIPTION OF THE INVENTION

Figure 1:
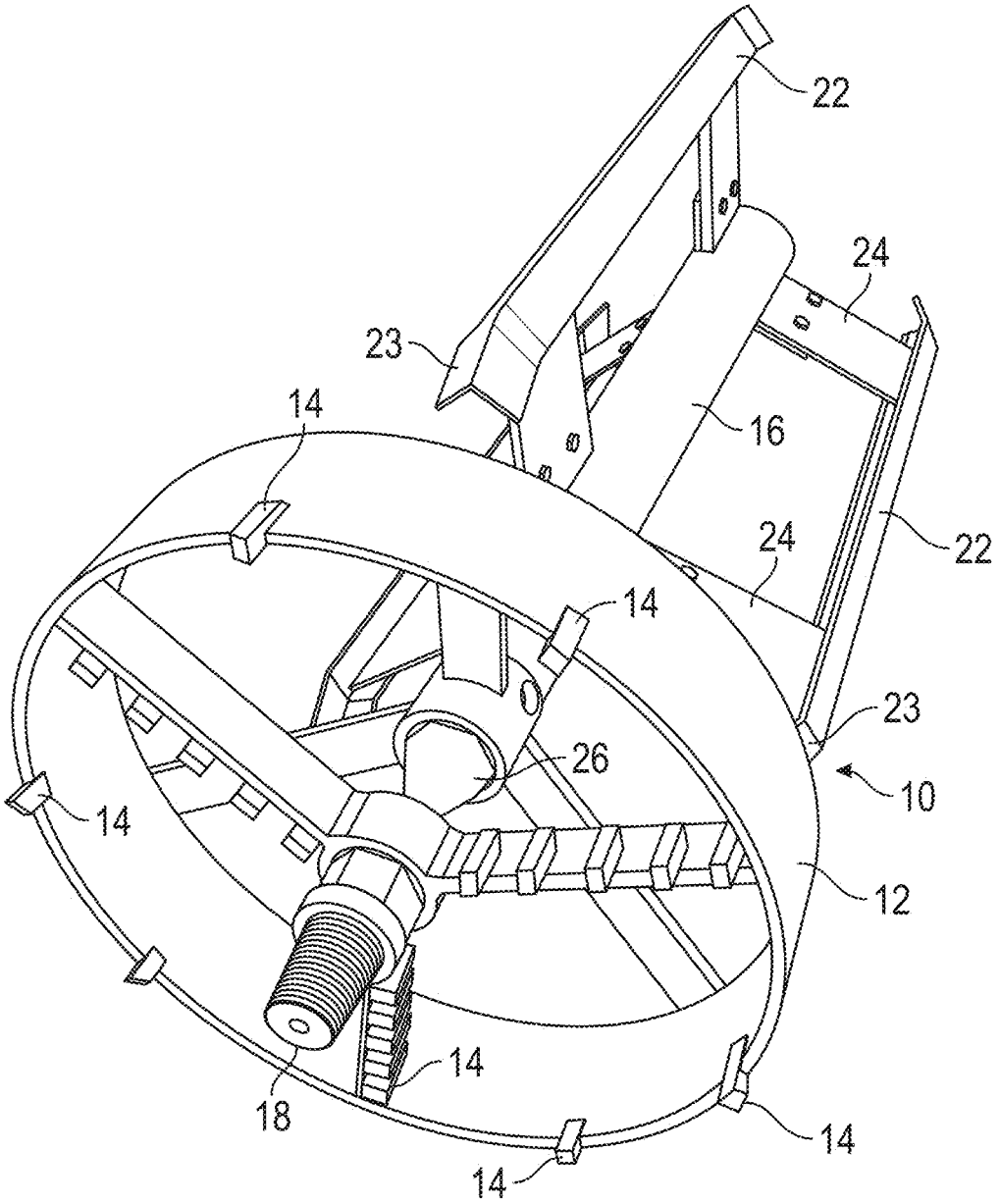
FIG. 1 is a perspective view of the pipe cleaning tool of the present invention, for use in a large diameter pipe.
Figure 2:
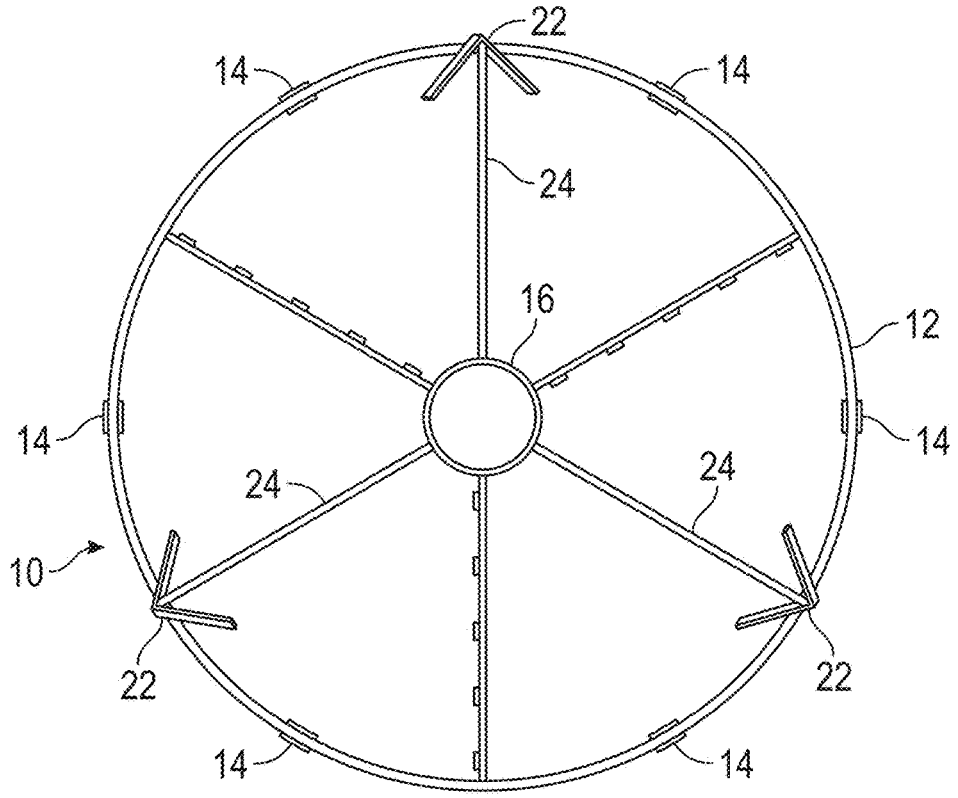
FIG. 2 is an end elevation of the tool shown in FIG. 1, according to the present invention.
Figure 3:
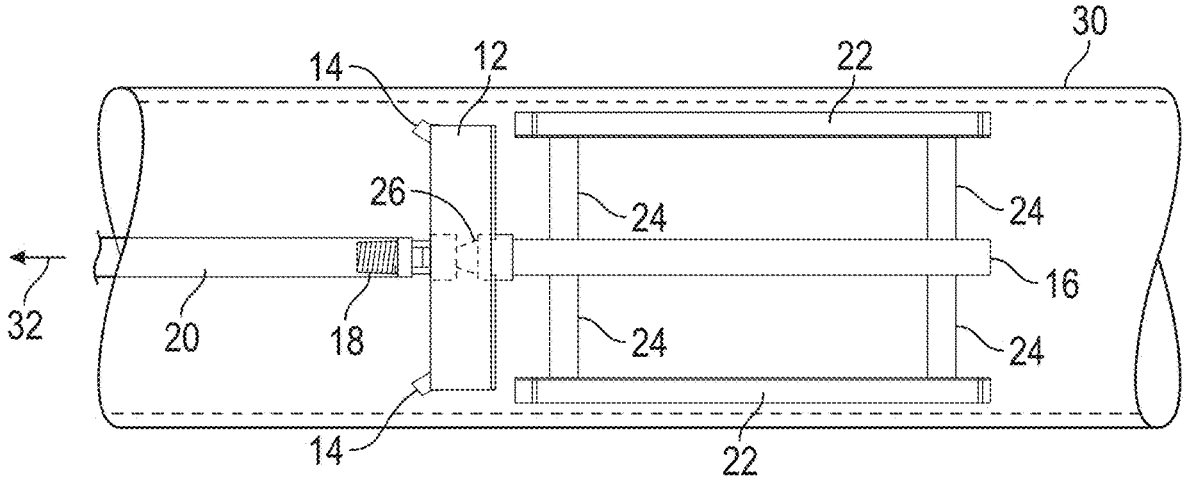
FIG. 3 is a side elevation view of the tool shown in FIG. 1, attached to shaft which pulls the tool through a pipe.

The pipe cleaning tool of the present invention is a close tolerance pipe honing reamer and is generally designated by the reference numeral 10 in FIGS. 1-3. The reamer or tool 10 includes a honing head 12 having a plurality of cutting elements 14 on the forward end of the head. The honing head 12 is mounted on a hollow shaft 16. The forward end of the shaft 16 includes threads 18 for connection to a horizontal drilling machine 20 or pit launch unit, which pulls the tool 10 through the pipe 30, in the direction indicated by arrow 32 in FIG. 3, while rotating the honing head 12.

The shaft 16 extends rearwardly behind the honing head 12 and supports a plurality of centering or stabilizing legs or bars 22. Preferably, at least three legs are provided on the tool 10. The legs 22 are fixed to the shaft 16 by support arms 24. The legs 22 may have various configurations, but in one preferred embodiment, the legs are V-shaped, with the apex facing radially outwardly. In a preferred embodiment, the forward ends of the legs may have a bend, as shown in FIG. 1, which functions to direct the debris removed from the pipe wall rearwardly away from the head 12.

The legs 22 are elongated and extend longitudinally to form a perimeter or diameter which is slightly less than the inside diameter of the pipe and slightly greater than the outside diameter of a perimeter defined by the honing head cutting elements 14. The legs 22 thus provide stability to the honing head 12, and maintain the honing head in close tolerance to the inside wall of the pipe, without the cutting elements 14 touching the inside wall. The cutting elements 14 thus clean the inside pipe wall and provide a smooth surface for laminar fluid flow or for liner installment.

The honing reamer tool 10 can be substantially of any size, for example, from 6 inches to 48 inches in diameter. The reamer tool 10 can cut out hard material quickly in a single pass due to the high rotation torque of the drilling machine 20. The reamer tool 10 is more cost effective than prior art high pressure water jets, which sometimes require multiple passes through the pipe. The cutting elements 14 leave a very smooth internal pipe wall.

Each honing head 12 is custom built to fit a specific pipe size and material. Interchangeable heads 12 and support legs 22 can be mounted on the shaft 16. The honing head is operated at high rotational speed and torque to provide fast and effective cleaning of the internal pipe wall. Long pipe runs can be cleaned with the tool 10. The legs 22 center the honing head 12 within the pipe 30 to maintain close tolerance of the cutting elements 14, without the elements 14 touching the internal wall of the pipe 30.

The shaft 16 includes multiple outlets or holes 26 through which water or other lubricating fluid can be ejected inside the pipe as the tool 10 is operated. The water or liquid mixes with the debris and material cut by the elements 14 and helps flush the debris out of the pipe.

The cutting elements 14 are held in close tolerance, preferrably ⅛ inch-1/16 inch to the internal pipe wall, leaving a very smooth finish needed for relining or to increase laminar fluid flow through the pipe and eliminating or minimizing turbulent flow.

Figure 4:
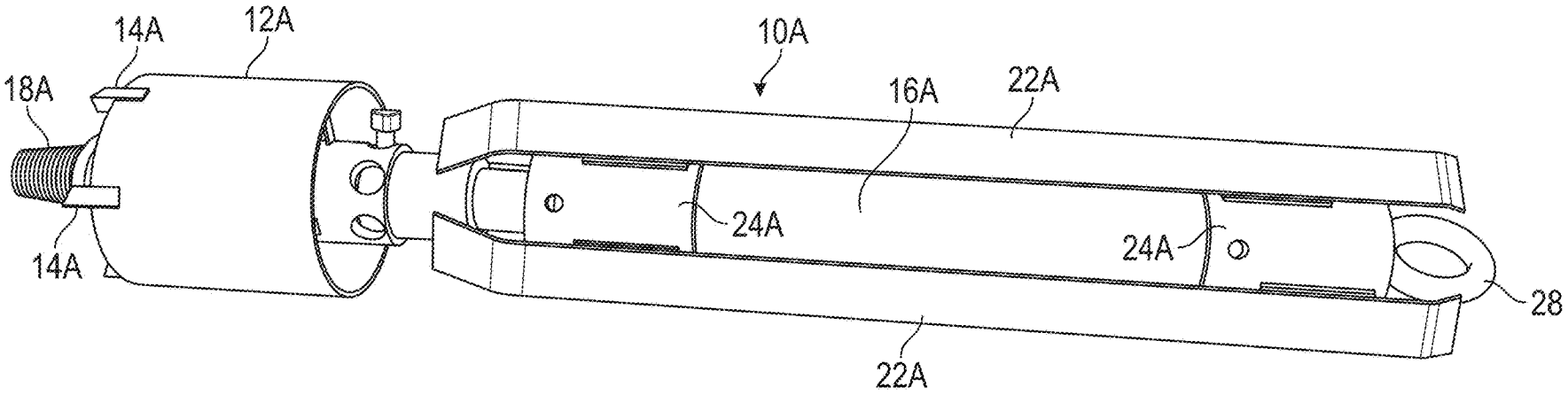
FIG. 4 is a perspective view of an alternative embodiment of a pipe cleaning tool, according to the present invention, for use in a small diameter pipe.

FIG. 4 shows an alternative embodiment of the cleaning tool 10A for use in small diameter pipes, as compared to the tool 10 used in large diameter pipes. Tools 10 and 10A have substantially similar components and function in substantially the same way. More particularly, the tool 10A includes a honer or reaming head 12A with cutting elements 14A. The head 12A is mounted on a hollow shaft 16A which is adapted to be coupled to the machine to pull and rotate the tool 10A, in a manner similar to that described above with respect to tool 10. Tool 10A has stabilizing legs 22A mounted to the shaft 16A via collars 24A with short legs standing radially outwardly between the collar 24A and the legs 22A. A ring 28 is provided on the rear end of the shaft 16A, to allow the tool 10A to be connected to a cable or other means for pulling the tool 10A rearwardly through the pipe.

The tools 10 and 10A and their method of use protects the pipe 30 from damage. The tools 10 and 10A can remove hard deposits inside the pipe 30, such as calcium, which often is not removed by high pressure water cleaning.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of cleaning an inside wall of a pipe, comprising:

inserting a honer head mounted on a shaft into the pipe, the honer head having perimeter cutting elements;

connecting the shaft to a rotatable pulling machine;

rotating the shaft and the honer head as the honer head is pulled through the pipe by the pulling machine so as to clean the inside wall;

stabilizing the honer head inside the pipe with legs on the shaft such that the honer head is in close tolerance to the inside wall without touching the inside wall.

2. The method of claim 1 further comprising supplying liquid into the pipe adjacent the honing head to remove debris.

3. The method of claim 2 wherein the liquid is introduced through the shaft and ejected through holes in the shaft.

4. The method of claim 1 further comprising lubricating the honer head during cleaning.

5. The method of claim 1 wherein the legs extend longitudinally behind the honer head and radially outwardly from the shaft.

6. The method of claim 1 wherein the honer head has cutting elements to remove material on the inside wall of the pipe without damaging the pipe.

7. The method of claim 1 further comprising directing debris removed from the internal wall of the pipe rearwardly with angled portions on the legs.

8. The method of claim 1 further comprising substituting a second honer head for the honer head on the shaft.

9. The method of claim 1 wherein the honer head is selective from a set of different honer heads.

* * * * *